US005560726A

United States Patent [19]

Kawaguchi

[11] Patent Number: 5,560,726

[45] Date of Patent: Oct. 1, 1996

[54] SHEET CONVEYING DEVICE INCLUDING A ROTATING MEMBER WITH POINTED TEETH WHOSE TIPS HAVE A RADIUS OF CURVATURE EQUAL TO OR LESS THAN 0.05 MM

[75] Inventor: Koichiro Kawaguchi, Yokohama, Japan

[73] Assignee: Canon Kabushiki Kaisha, Tokyo, Japan

[21] Appl. No.: 231,065

[22] Filed: Apr. 22, 1994

[30] Foreign Application Priority Data

Apr. 28, 1993 [JP] Japan ..... 5-123172

[51] Int. Cl.[6] ..... B41J 13/08

[52] U.S. Cl. ..... 400/641; 347/104

[58] Field of Search ..... 400/636, 641; 347/104

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/14 R |
| 4,723,129 | 2/1988 | Endo et al. | 346/1.1 |
| 4,740,796 | 4/1988 | Endo et al. | 346/1.1 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—David A. Wiecking

*Attorney, Agent, or Firm*—Fitzpatrick, Cella, Harper & Scinto

[57] ABSTRACT

A recording apparatus includes a recording head for performing recording on a sheet, a first rotating member, disposed at a side downstream from the recording head so as to contact a non-recorded surface of the sheet on which recording has been performed by the recording head, for supplying the sheet with a conveying force, and a second rotating member, including pointed teeth at its outer circumference, for conveying the sheet in cooperation with the first rotating member while distal ends of the teeth contact a recorded surface of the sheet. The radius of curvature of the tips of the teeth are equal to or less than 0.05 mm.

7 Claims, 7 Drawing Sheets

FIG.3

| RADIUS OF CURVATURE OF DISTAL END OF SPUR'S TIP R(mm) | 0.02 | 0.03 | 0.04 | 0.05 | 0.06 | 0.07 | 0.08 |
|---|---|---|---|---|---|---|---|
| TRACES OF INK PRODUCED BY SPUR ON OHP SHEET | ○ | ○ | ○ | ○ | △ | × | × |

○ NO TRACES

△ SLIGHT TRACES PRESENT

× CLEAR TRACES PRESENT

FIG.4
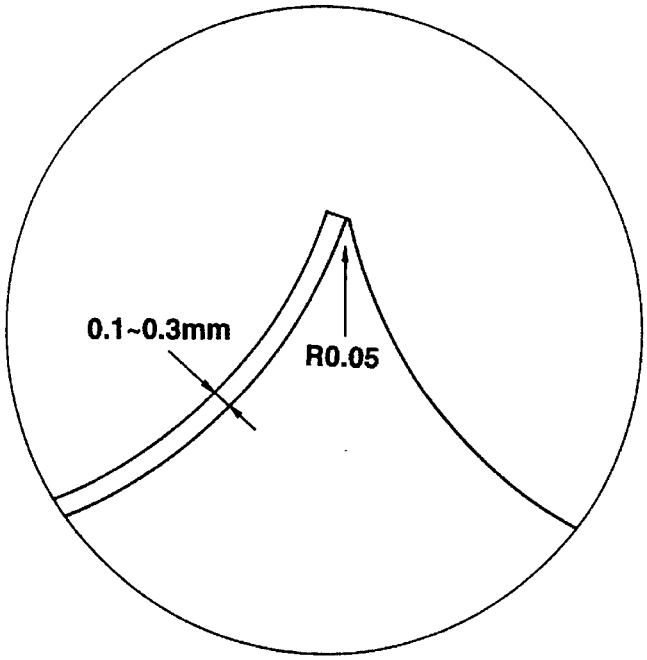
FIG.5(b)
FIG.5(a)
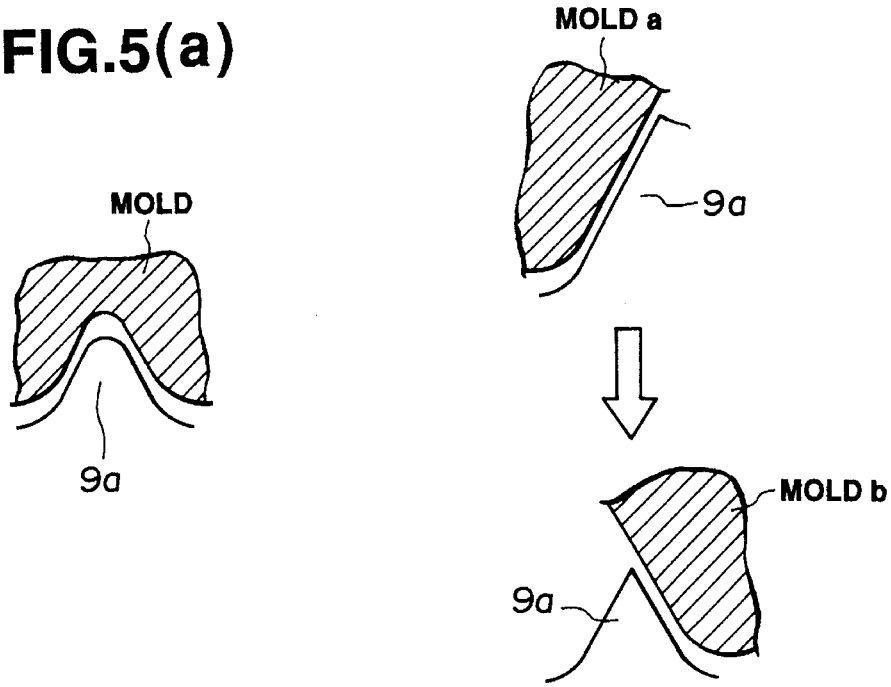

FIG.6

| PROCESSING METHOD | MOLDING | ORDINARY PRESS (SINGLE SHOT) | DOUBLE-SHOT PRESS |
|---|---|---|---|
| LIMIT VALUE OF R IN PROCESSING OF DISTAL END OF SPUR'S TIP (mm) | 0.08 | 0.08 | 0.02 |

SHEET CONVEYING DEVICE INCLUDING A ROTATING MEMBER WITH POINTED TEETH WHOSE TIPS HAVE A RADIUS OF CURVATURE EQUAL TO OR LESS THAN 0.05 MM

BACKGROUND OF THE INVENTION

1. Field of the Invention

This invention relates to a sheet conveying device or a sheet discharging device, which is mounted in a recording apparatus, such as a printer mounted, for example, in an information output apparatus, such as a computer, a copier or a facsimile apparatus.

2. Description of the Related Art

In a conventional sheet discharging device mounted in a recording apparatus, such as a printer or the like, a discharging roller, which is rotatably driven by a transmitted driving force, and a spur, which is rotatably driven by the discharging roller in pressure contact therewith, are provided. As shown in FIG. 7, sawtooth tips 51*a* are formed on the circumference of a spur 51 in order to minimize the spur's contact with a recording surface of a sheet on which an image has been recorded. The tips 51*a* are formed by pressing a metallic thin plate in a single shot, or by molding.

In the above-described conventional recording apparatus, however, when coated paper, ordinary paper, an OHP (overhead projector) sheet or the like is used as a recording material, ink adhering to the tips 51*a* of the spur 51 may stain a white region of the sheet, or the surface of the sheet recorded by another color.

The influence of the spur at a sheet discharging portion is greater in the case of a color printer than in the case of a monochromatic (black and white) printer. That is, even a slight amount of ink adhering to the spur becomes in a wet state in contact with unfixed ink having another color after one revolution of the spur to cause color mixture, thereby staining the recorded surface of the sheet.

In a sheet on which it is difficult to fix ink, staining by the ink adhered to the spur is likely to occur because wetting by the ink on the sheet is remarkable. Particularly in an OHP sheet, slip occurs between the spur and the liquid surface of unfixed ink on the sheet, thereby easily producing linear slip traces depending on the relative speed between the spur and the sheet. In an ink-jet-recording color printer, various kinds of recording materials, such as an OHP sheet, ordinary paper and the like, are used in addition to coated paper. Hence, slip traces caused by the spur are remarkably produced on the recorded surface of the sheet, especially when recording is performed on a recording material having low fixability.

FIGS. 8 and 9 schematically illutrate stains produced on the recorded surface of a sheet P by the spur 51. FIG. 8 illustrates stains caused by black ink (Bk) redissolved in wet red ink (R) on the sheet P. FIG. 9 illustrates black points (Bk1), and black lines (Bk2) caused by slip produced on the sheet P having low ink fixability. In FIG. 8, a discharging roller 52 is rotatably driven by a transmitted driving force. The spur 51 is rotatably driven by the discharging roller 52 in pressure contact therewith. FIG. 10 is an enlarged view illustrating the contact portion between the OHP sheet P and the spur 51, and illustrates a state in which black ink (Bk) and green ink (G) adhere to a coated layer C on the OHP sheet P having a thickness of about 80–200 μm, and the tip 51*a* of the spur 51 slips in the direction of the arrow caused by the green ink.

SUMMARY OF THE INVENTION

It is an object of the present invention to solve the above-described problems.

It is another object of the present invention to provide a sheet discharging device, in which by minimizing the amount of ink adhering to a spur, retransfer of the ink to a sheet and slip of the spur on the surface of the sheet having unfixed ink are prevented, so that the quality of the obtained image can be maintained at a high level.

According to one aspect, the present invention which achieves these objectives relates to a sheet discharging device for discharging a sheet on which an image has been recorded, comprising a discharging rotating member rotatably driven by a transmitted driving force, and a spur rotatably driven by the discharging rotating member in pressure contact therewith. The radius of curvature of the spur's tip is equal to or less than 0.05 mm.

According to the above-described configuration, by making the radius of curvature of the tip of the spur, rotatably driven by the discharging rotating member in pressure contact therewith, equal to or less than 0.08 mm so as to have an acute angle, the amount of ink adhering to the spur is minimized, whereby retransfer of the ink to the sheet can be prevented. Furthermore, since a sufficient frictional force can be maintained even if the spur's tip contacts the surface of the sheet having unfixed ink, slip is not produced between the spur and the sheet. Hence, the spur is rotatably driven at the same speed as the sheet-conveying speed.

BRIEF DESCRIPTION OF THE DRAWINGS

FIG. 3 is a table illustrating the relationship between the radius of curvature of a spur's tip and traces of ink produced by the spur on an OHP sheet;

FIG. 4 is a diagram illustrating a spur's tip;

FIGS. 5(*a*) and 5(*b*) are diagrams illustrating a spur's tip when the spur is manufactured by single-shot press and double-shot press, respectively;

FIG. 6 is a table illustrating limit values of the radius of curvature R of a spur's tip in respective processing methods;

DETAILED DESCRIPTION OF THE PREFERRED EMBODIMENT

Figure 1:
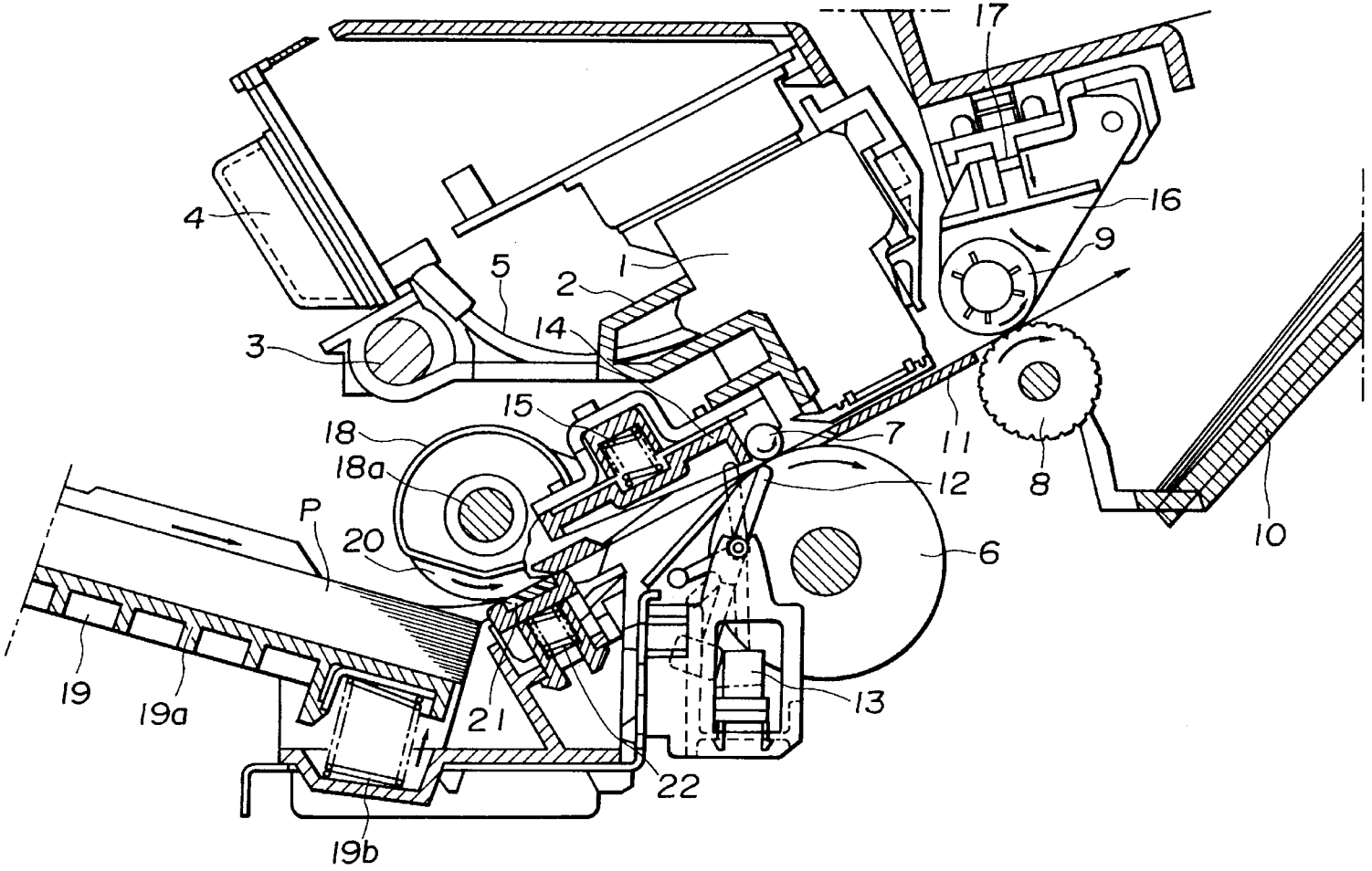
FIG. 1 is a cross-sectional view of a serial recording apparatus for performing recording by scanning a recording material with recording means in a sub-scanning direction while intermittently moving the recording material in a main scanning direction.
Figure 2:
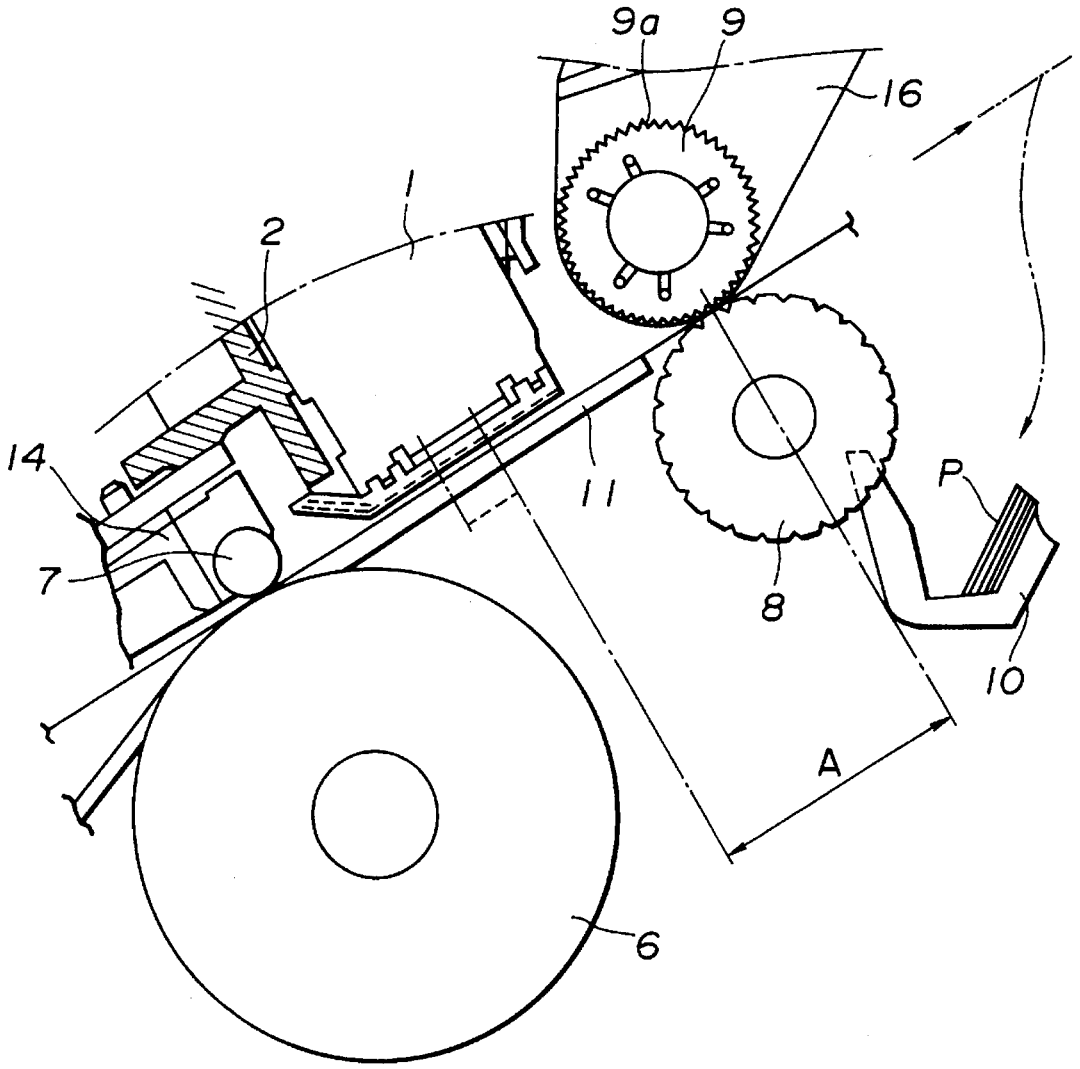
FIG. 2 is a diagram illustrating a sheet discharging device.
Figure 7:
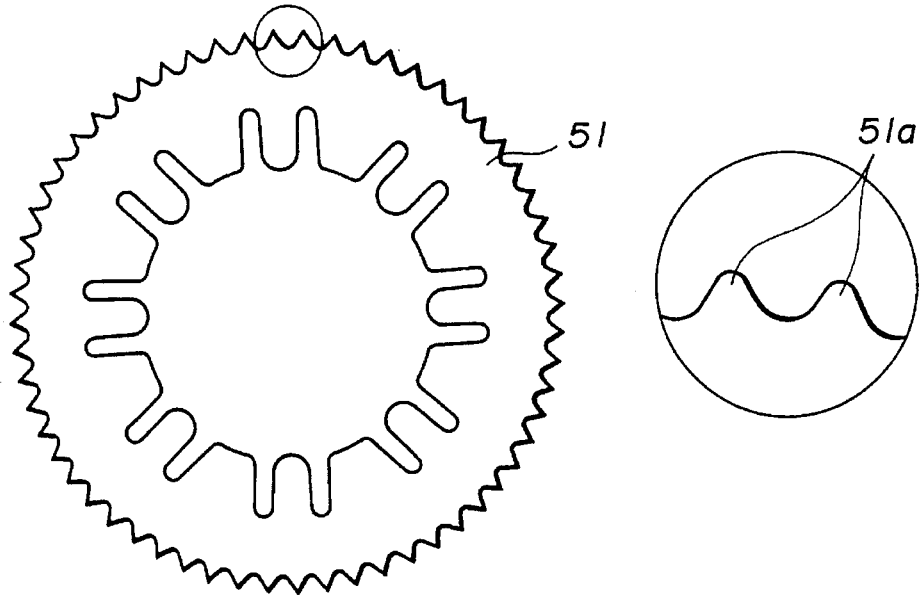
FIG.7 (PRIOR ART)
FIG. 7 is a diagram illustrating a conventional spur.
Figure 8:
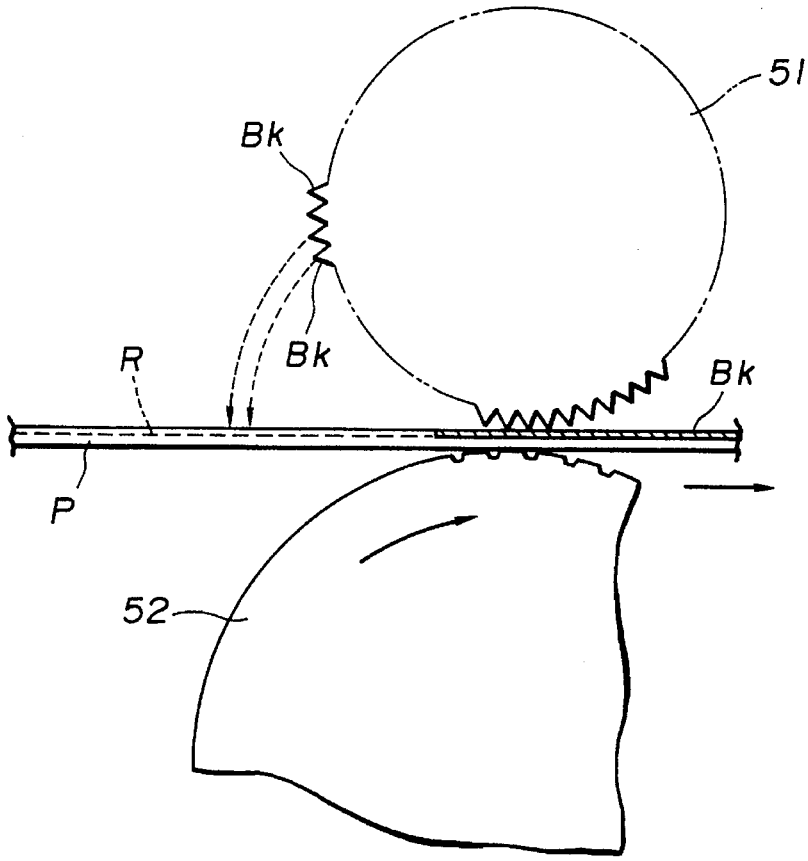
FIGS. 8 and 9 are diagrams illustrating stains in recording in a conventional sheet discharging device.
Figure 9:
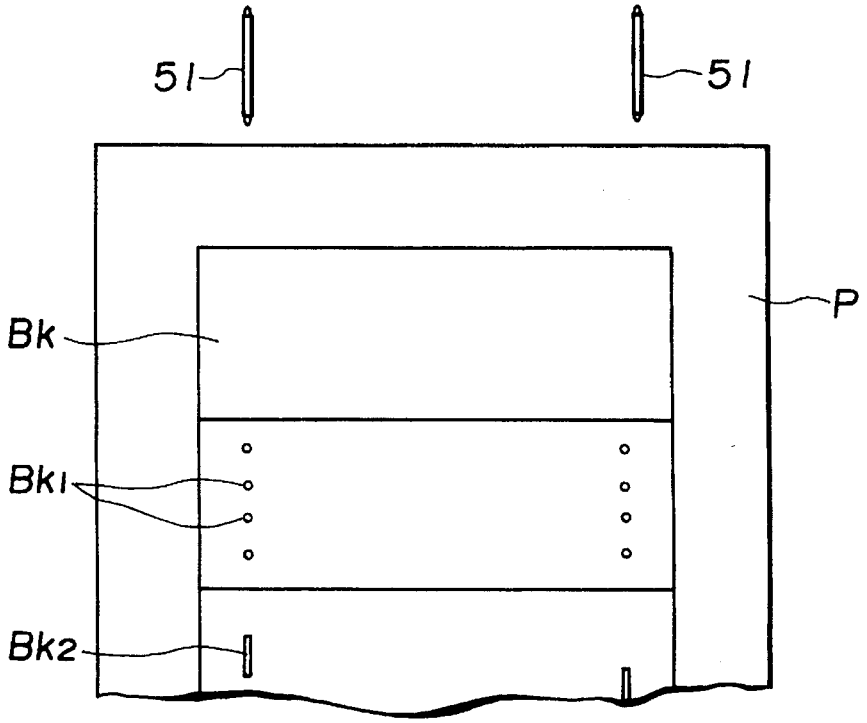
Figure 10:
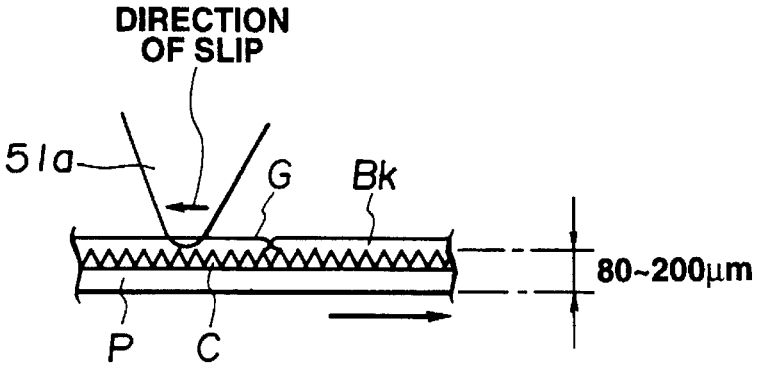
FIG. 10 is a diagram illustrating slip between an OHP sheet and a spur in a conventional sheet discharging device.

A description will now be provided of a recording apparatus according to an embodiment of the present invention. In the present embodiment, an ink-jet-type recording apparatus is used as the recording apparatus. FIG. 1 is a cross-sectional view of a serial recording apparatus for performing recording by scanning a recording material with recording means in a sub-scanning direction while intermittently moving the recording material in a main scanning direction. FIG. 2 is a diagram illustrating a sheet discharging device. FIG. 3 is a table illustrating the relationship between the radius of curvature of a spur's tip and traces of ink produced by the spur on an OHP sheet. FIG. 4 is a diagram illustrating a spur's tip. FIGS. 5(*a*) and 5(*b*) are diagrams illustrating a spur's tip when the spur is manufactured by single-shot press and double-shot press, respectively. FIG. 6 is a table illustrating limit values of the radius of curvature R of a spur's tip in respective processing methods.

First, the schematic configuration of the recording apparatus will be described with reference to FIG. 1. In FIG. 1, a recording head 1 is mounted on a carriage 2, which reciprocates in a sub-scanning direction (a direction perpendicular to the plane of FIG. 1) along a carriage shaft 3. The recording head 1 records on a recording sheet P, serving as a recording material, by discharging ink in accordance with image information.

This apparatus is operated by an ink-jet recording method, in which recording is performed by discharging ink from the recording head. The recording head includes fine liquid-discharging ports (orifices), a liquid channel, an energy-acting portion provided at a part of the liquid channel, and energy generation means for generating liquid-drop formation energy to act on a liquid present at the energy-acting portion.

The above-described energy generation means comprises, for example, an electromechanical transducer, such as a piezoelectric element or the like, energy generation means in which the liquid is heated by irradiating an electromagnetic wave, such as laser light or the like, and liquid drops are discharged caused by the heating, or energy generation means in which the liquid is heated by an electrothermal transducer, such as a heating element having heating resistors, or the like, to discharge liquid drops.

In particular, various kinds of recording heads, of an ink-jet recording method in which a liquid is discharged by thermal energy, can perform high-resolution recording, because liquid discharging ports (orifices) for forming liquid drops to be discharged can be arranged at a high density. Among such recording heads, a recording head which uses an electrothermal transducer as the energy generation means is advantageous, because the size can be easily reduced, and advantages of the IC (integrated circuit) technology and the microprocessing technology, which have remarkably progressed with improved reliability in the semiconductor manufacturing field, can be fully utilized, whereby components can be mounted at a high density and the production cost can be reduced.

The above-described carriage 2 includes an ink tank 4, which supplies the recording head 1 with ink via an ink pipe 5.

A conveying roller 6 is rotatably driven in the direction of the arrow by driving means (not shown). A driven roller 7 is rotatably driven by the conveying roller 6 in pressure contact therewith. A recording sheet P is conveyed to a recording position while being grasped between the conveying roller 6 and the driven roller 7.

A discharging roller 8 is rotatably driven in the direction of the arrow by driving means (not shown). A spurlike rotating member 9 is rotatably driven by the discharging roller 8 in pressure contact therewith. The recording sheet P, which has been conveyed from the recording position to the downstream side by the discharging roller 8 and the spur 9, is discharged onto a discharging stacker 10 provided outside the apparatus. A recording sheet guide (platen) 11 supports the recording sheet P at the recording position. The recording head 1 is disposed so as to face the recording sheet guide 11 while forming a slight gap therewith, and moves in parallel to the recording sheet guide 11 in the main scanning direction.

A sensor lever 12 detects the leading end and the trailing end of the recording sheet P. The sensor lever 12 is disposed so as to be rotatable from the pressure-contact point between the conveying roller 6 and the driven roller 7 to the upstream side in the sheet conveying direction. A photosensor 13 converts the operation of the sensor lever 12 into an electrical signal. A holding member 14 holds the driven roller 7. A pressing spring 15 causes the driven roller 7 to be in pressure contact with the conveying roller 6 by pressing the holding member 14. A holding member 16 holds the driven roller 9. A pressing spring 17 causes the driven roller 9 to be in pressure contact with the discharging roller 8 by pressing the holding member 16.

A semicircular feeding roller 18 picks up and feeds the recording sheet P from a feeding stacker 19 in a sheet feeding operation. An idle roller 20, having an outer diameter smaller than the outer diameter of the feeding roller 18, is provided on a feeding-roller shaft 18*a*. The feeding roller 18 is in a waiting state with its notched surface placed downward. The idle roller 20 is mounted so as to be freely rotatable relative to the feeding-roller shaft 18*a*. A frictional piece 21 is provided at a position facing the feeding roller 18, and is pressed upward by a spring 22. The frictional piece 21 individually separates and feeds the recording sheets P fed from the feeding stacker 19. A pressing plate 19*a*, on which the recording sheets P are mounted, is provided in the feeding stacker 19, and is pressed upward from the base side by a pressing-plate spring 19*b*, so that the feeding roller 18 contacts the uppermost recording sheet P when it rotates.

As shown in FIG. 2, the recording sheet P is fed between the recording head 1 and the recording-sheet guide 11, intermittently, by a predetermined amount, while being grasped between the conveying roller 6 and the driven roller 7. Recording is performed by driving the recording head 1 while scanning the carriage 2. The recording sheet P, after recording, is grasped and conveyed by the discharging roller 8 and the spur 9, and is discharged onto the discharging stacker 10.

Ink recorded on the recording sheet P at the recording portion is not always securely fixed while the recording sheet P is conveyed a distance A up to the spur 9. In the case of a color printer, the ink adhering to tips 9*a*, of the spur 9, is mixed with ink having another color when the spur 9 contacts the wet recorded surface on which the ink having the other color has been discharged, thereby causing stains on the recorded surface. It is desirable to minimize the amount of ink adhering to the tips 9*a* of the spur 9.

In the present embodiment, the spur 9 is formed by performing a two-shot press of a metallic thin plate, so that the radius of curvature R, of the tip 9*a*, is equal to or less than 0.05 mm. As shown in FIG. 4, the thickness of the spur 9 is 0.1–0.3 mm. The outer diameter of the spur 9 is 15 mm, the height of the tip 9*a* is 0.5 mm, and the width of the tip 9*a* is 0.7 mm. FIG. 3 is a table illustrating the relationship, obtained from experiments, between the radius of curvature R, of the tip 9*a* of the spur 9, and traces of ink produced by the spur 9 when an entirely black image is recorded on an OHP sheet. This table indicates that no traces of ink are produced when the value of R is equal to or less than 0.05 mm.

FIG. 5(*a*) illustrates a tip 9*a* produced by molding or by an ordinary one-shot press. In this case, the radius of curvature R, of the tip 9*a*, cannot have a small value due to a limitation in the processing of a mold for a distal-end portion of the tip 9*a* having an acute angle.

FIG. 5(*b*) illustrates the tip 9*a* produced by performing a two-shot press of the spur 9. In this case, since the tip 9*a* is pressed in two shots, using two molds "a" and "b", the tip 9*a* can be processed so as to have an acute angle. Hence, the radius of curvature R can be reduced. The press may be performed in three shots or more depending on the number of the tips 9*a* of the spur 9.

FIG. 6 is a table illustrating limit values of the radius of curvature R, of the tip 9*a* of the spur 9, obtained in respective processing methods; i.e., molding, one-shot press and two-shot press. This table indicates that the two-shot press has a superior processing capability for the tip 9*a* compared with the other processing methods.

In the present embodiment, austinitic stainless steel (SUS631-CSPH), having a high hardness (a Vickers hardness of at least 450 HV), is used for a metallic thin plate, which serves as the base material for the spur 9. Hence, a spur 9 having excellent durability can be provided.

According to the above-described configuration, by making the radius of curvature R of the tip 9*a* of the spur 9 equal to or less than 0.05 mm, the tips 9*a* can be formed so as to have an acute angle. Hence, it is possible to minimize the amount of ink adhering to the spur 9, and to prevent retransfer of the ink onto the recording sheet P. Even if the tips 9*a* contact a portion of the recording sheet P having unfixed ink, slip does not occur between the spur 9 and the recording sheet P. Hence, the quality of the obtained image can be maintained at a high level.

The spur 9 may be formed by etching instead of by press. In this case, the limit value of the radius of curvature R of the tip 9*a* is about 0.03 mm. Hence, a radius of curvature R having a value equal to or less than 0.05 mm can be realized as in the case of a two-shot press. This is because in the case of etching, an artwork is formed by printing, and therefore tips in the artwork can have an acute angle.

In the case of etching, tips can have an acuter angle in double-side etching than in single-side etching. Also, in etching, austenitic stainless steel has a high wear-resistant property.

Although in the above-described embodiment an ink-jet recording method has been adopted, a better result will be obtained if recording is performed by passing current in an electrothermal transducer in accordance with a recording signal, and discharging ink from discharging ports by the growth and contraction of bubbles generated in the ink, utilizing film boiling produced in the ink and caused by thermal energy supplied from the electrothermal transducer.

The configuration of such a device is preferably based on the principle of such recording disclosed, for example, in U.S. Pat. Nos. 4,723,129 and 4,740,796. The above-described recording method may be applied to any of so-called on-demand type and continuous type. In the case of the on-demand type, thermal energy is generated in an electrothermal transducer, disposed facing a sheet across a liquid channel containing a liquid (ink), by supplying it with at least one driving signal for realizing an abrupt temperature rise exceeding nucleate boiling in accordance with recording information, to generate film boiling at the heat-acting surface of the recording head. As a result, a bubble corresponding to the driving signal can be formed within the liquid. Hence, the on-demand type is more effective. At least one liquid drop is formed by discharging the liquid through the discharging port utilizing the growth and contraction of the bubble. It is desirable to supply the driving signal in the form of a pulse, because the growth and contraction of the bubble is properly performed instantaneously. Hence, the liquid can be discharged in an excellent manner.

The above-described pulse-like driving signal is preferably a signal described in U.S. Pat. Nos. 4,463,359 or 4,345,262.

Better recording may be performed if conditions described in U.S. Pat. No. 4,313,124, relating to the rate of the temperature rise of the heat acting surface, are adopted.

In addition to the configuration of the recording head disclosed in the above-described specifications in which discharging ports, a liquid channel and an electrothermal transducer are combined (a linear liquid-flowing channel or an orthogonal liquid-flowing channel), configurations disclosed in U.S. Pat. Nos. 4,558,333 and 4,459,600, in which the heat acting surface is disposed at a bent region, may also be adopted.

The present invention may also be effectively applied to a configuration disclosed in Japanese Patent Laid-open Application (Kokai) No. 59-123670 (1984), in which a common slit is used as a discharging port for a plurality of electrothermal transducers, and a configuration disclosed in Japanese Patent Laid-open Application (Kokai) No. 59-138461 (1984), in which apertures absorbing a pressure wave caused by thermal energy are used as discharging ports. That is, according to the present invention, recording can be securely and efficiently performed irrespective of the type of the recording head.

The above-described recording head may be a recording head fixed to a carriage, an interchangeable chip-type recording head, which can realize electrical connection to the main body of the apparatus and supply ink from the main body of the apparatus by being mounted on a carriage, a cartridge-type recording head in which an ink tank is provided as a single unit with the recording head, etc.

Addition of recovery means for the recording head, preliminary auxiliary means, and the like, to the recording apparatus is preferable, because the effects of the present invention may be further improved. More specifically, addition of capping means, cleaning means, pressurizing means or suction means, preliminary heating means using an electrothermal transducer, another heating element, or combination of these devices, and a preliminary discharging mode for performing a discharging operation other than recording, is effective for performing more stable recording.

As for the kind or the number of recording heads mounted on a carriage, in addition to the configuration in which only one head is provided corresponding to ink having a single color, a plurality of heads may be provided corresponding to a plurality of ink having different colors or densities. That is, the present invention may be applied not only to a recording apparatus adopting a recording mode using only a main color, such as black or the like, but also to a recording apparatus which uses at least one of a plurality of different colors and a full color obtained by mixing colors, including a plurality of recording heads provided as a single unit.

In the present embodiment, a description has been provided assuming that ink is a liquid. However, ink may be solidified at or below the room temperature, and softened or liquidized at the room temperature. In general, in an ink-jet recording method, the temperature of ink is controlled within a range between 30° C. and 70° C. so as to maintain the viscosity of the ink within a stable discharging range. Hence, it is only necessary that the ink is liquidized when a recording signal is supplied. The present invention may also be applied to cases in which ink having a property of being first liquidized by thermal energy is used. For example, a temperature rise by thermal energy may be actively prevented by using the energy as energy required to change the state of ink from a solid state to a liquid state, or ink which solidifies in a shelf state may be used in order to prevent evaporation of the ink. The ink is liquidized by thermal energy corresponding to a recording signal, the liquid ink is discharged, and the ink may already start to solidify when it has reached the recording sheet.

As described in Japanese Patent Laid-open Application (Kokai) Nos. 54-56847 (1979) or 60-71260 (1985), the ink used in the above-described cases may face an electrothermal transducer in a state of being held as a liquid or a solid in a recessed portion of a porous sheet or in a threaded hole. The above-described film boiling method is most effective for such ink.

The above-described ink-jet recording apparatus may be used not only as an image output terminal of an information processing apparatus, such as a computer or the like, but also as a copier combined with a reader or the like, a facsimile apparatus having a transmission/reception function, or the like.

Although a description has been provided of cases in which the ink-jet recording method is adopted as the recording method, the present invention is not limited to the ink-jet recording method. The present invention may be applied to a thermal transfer recording method, a thermal recording method, or any recording method other than impact recording methods, such as a wire-dot recording method and the like.

As described above, according to the present invention, by making the radius of curvature of the tip of a spur to be equal to or less than 0.05 mm, the tip can have an acute angle. As a result, the amount of ink adhering to the spur can be minimized, and retransfer of the ink to a sheet can be prevented. Furthermore, even if the tips contact a portion of the sheet having unfixed ink, slip between the spur and the sheet does not occur, and therefore the quality of the obtained image can be maintained at a high level.

In addition, by using a thin plate having a thickness equal to or less than 0.3 mm for the spur, the cross section of the spur is reduced to increase the surface pressure. Hence, slip between the spur and the sheet will less frequenly occur. By using the thin plate having a thickness of at least 0.1 mm, deformation of the spur during an assembling operation can be prevented.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus comprising:

recording means for performing recording on a sheet;

a first rotating member, disposed at a side downstream from said recording means so as to contact a non-recorded surface of the sheet on which recording has been performed by said recording means, for supplying the sheet with a conveying force; and a second rotating member, including pointed teeth at its outer circumference, for conveying the sheet in cooperation with said first rotating member, while distal ends of the teeth contact a recorded surface of the sheet, wherein the radius of curvature of the tips of the teeth are equal to or less than 0.05 mm.

2. A recording apparatus according to claim 1, wherein the area of the teeth in contact with the sheet is very small.

3. A recording apparatus according to claim 1, wherein stainless steel (SUS631-CSPH) is used as the base material of the teeth.

4. A recording apparatus according to claim 1, wherein the teeth have a thickness between 0.1 mm and 0.3 mm.

5. A recording apparatus according to claim 1, wherein said recording means performs recording on the sheet in accordance with image information.

6. A recording apparatus according to claim 1, wherein said recording means performs recording by discharging ink.

7. A recording apparatus according to claim 6, wherein said recording means records an image using ink liquid drops discharged by expansion of bubbles generated within ink by thermal energy.

* * * * *

UNITED STATES PATENT AND TRADEMARK OFFICE
CERTIFICATE OF CORRECTION

PATENT NO. : 5,560,726

DATED : October 1, 1996

INVENTOR(S) : KOICHIRO KAWAGUCHI

It is certified that error appears in the above-identified patent and that said Letters Patent is hereby corrected as shown below:

ON TITLE PAGE

[56] References Cited U.S. Patent Documents

Insert: --5,193,800 3/1993 Kashiwabara 400/641--;
--5,291,224 3/1994 Asano et al. 400/641--.

[56] References Cited Foreign Patent Documents

Insert: --59-022782 2/1984 Japan.--;
--1-267077 10/1989 Japan.--;
--472893 3/1992 Eur. Pat. Off. .--.

COLUMN 2

Line 22, "0.08mm" should read --0.05mm--.

COLUMN 3

Line 57, "spurlike" should read --spur-like--.

UNITED STATES PATENT AND TRADEMARK OFFICE

CERTIFICATE OF CORRECTION

PATENT NO. : 5,560,726

DATED : October 1, 1996

INVENTOR(S) : KOICHIRO KAWAGUCHI

It is certified that error appears in the above-identified patent and that said Letters Patent is hereby corrected as shown below:

COLUMN 5

Line 16, "austinitic" should read --austenitic--.

Signed and Sealed this

Eighteenth Day of March, 1997

*Attest:*

Bruce Lehman

BRUCE LEHMAN

*Attesting Officer*

*Commissioner of Patents and Trademarks*